United States Patent [19]

Thiis-Evensen

[11] 4,282,050

[45] Aug. 4, 1981

[54] PROCEDURE FOR COVERING ROOFS

[75] Inventor: Harald Thiis-Evensen, Porsgrunn, Norway

[73] Assignee: Isola Fabrikker A/S, Eidanger, Norway

[21] Appl. No.: 62,288

[22] Filed: Jul. 31, 1979

[30] Foreign Application Priority Data

Aug. 11, 1978 [NO] Norway ..... 782746

[51] Int. Cl.[3] ..... B32B 7/08; B32B 7/04

[52] U.S. Cl. ..... 156/71; 52/809; 156/92; 156/304.3; 428/61; 428/99; 428/189; 52/459; 52/460

[58] Field of Search ..... 156/71, 92, 304.3; 52/809, 403, 416, 459, 460; 428/52, 99, 189, 61

[56] References Cited

U.S. PATENT DOCUMENTS

| | | | |
|---|---|---|---|
| 3,763,614 | 10/1973 | Hyde et al. | 156/71 |
| 4,074,501 | 2/1978 | Sandqvist | 156/71 |
| 4,075,807 | 2/1978 | Alderman | 156/71 |
| 4,192,116 | 3/1980 | Kelly | 428/61 |

FOREIGN PATENT DOCUMENTS

| | | | |
|---|---|---|---|
| 2312353 | 9/1974 | Fed. Rep. of Germany | 52/809 |

*Primary Examiner*—Paul J. Thibodeau

*Attorney, Agent, or Firm*—Watson, Cole, Grindle & Watson

[57] ABSTRACT

The invention discloses a process of cladding a roof on a support structure which includes the step of applying an insulation layer on said support structure, applying edge abutting webs of cladding material over the insulation layer, simultaneously mechanically anchoring by fasteners the insulation and cladding webs to the support structure and sealing over the edges of the webs and fasteners by welding on welding strips covering said edges and fasteners.

1 Claim, 3 Drawing Figures

PROCEDURE FOR COVERING ROOFS

This invention relates to the cladding of roofs, for example flat or sloping roofs. Nowadays, most roofs which are cladded with felt or foil are insulated beforehand with compact insulation materials, for example rockwool or glasswool, expanded polystyrene or the like. Insulating material of this kind can for example be fixed in position by laying in hot asphalt or can be mechanically anchored. After this operation, a sealing layer is laid, this usually taking the form of rolls, which may be of plastic foil, an asphalt emulsion impregnated product or the like, which is fixed to the underlay by means of adhesive or for example by scattering on a layer of gravel of suitable thickness. The sealing material is normally laid with an overlap of 4–10 cm which is glued or welded, the latter operation commonly being effected by means of hot air, especially in connection with foils.

Roofing in accordance with the above mentioned method is accompanied by sundry disadvantages. For example, fixing of the sealing layer to the underlay by means of hot asphalt will be completely dependent upon water-free conditions, i.e. laying should not be effected under conditions of high humidity or during precipitation.

It is obviously an advantage to ensure that the insulating material is covered with the sealing layer as quickly as possible, which would be prevented for example if it were to rain, which would make laying in asphalt impossible. This would entail exposure of the insulation material to rain, and the wet insulation would have to be completely dried out before fastening the sealing layer to the insulation. Any dampness remaining inside the insulation may cause the subsequent formation of "blisters". Corresponding problems may also arise when artificial resin foils are employed instead of for example asphalt products.

It is naturally a great disadvantage that the cladding of roofs as described above is directly dependent upon the weather, and the problems are consequently greater in districts with frequent precipitation than in districts with relatively infrequent precipitation. Since the progress on a building site is partly dependent upon an impervious roof, a delay in roofing will consequently also delay subsequent operations and thus increase building costs. Since the adhesive at present almost exclusively used is hot asphalt, the aforedescribed procedure will necessarily comprise such operations as the heating of asphalt in a suitable container, and the transportation of the asphalt to the place where it is to be used.

In addition, in cases where stone finish is not necessary from the esthetic point of view the stone will represent a load on the roof structure which will necessarily represent an unnecessary increase of costs, since the roof structure and appurtenant supporting columns must be dimensioned accordingly.

Experience has also shown that as a result of the different properties of the individual components, for example as regards thermal movement, a roof cladding laid as described above will be subject to ruptures of the impervious layer and consequent leaks. In cases where expanded synthetic resin is used as insulation it is also important that this has had the opportunity to stabilize after production so that its dimensions are relatively stable.

By means of the present invention some of the above mentioned disadvantages can be completely or partly avoided. In accordance with the present procedure all the elements included in the roof, which in the main are the same elements as above mentioned, are laid out loose on the supporting structure, but the anchorage of the elements to the supporting structure is not effected until the final phase of the sealing operation. In this manner the operations which increase expenses are avoided, such as for example the anchorage of insulation material to the underlay with the aid of hot asphalt or by means of mechanical anchorage before the sealing layer is laid. By this procedure the laying of the sealing layer will only to a limited degree by dependent upon the meteorological conditions, because the sealing layer can be laid directly on the insulating material without any prior anchorage in hot asphalt, an operation which as previously mentioned is to a high degree dependent upon the existing type of weather.

The procedure according to the invention is carried out as follows:

First a conventional vapour barrier may be laid on the roof if required, whereupon this is covered with insulating material corresponding to that described above. Thereupon the impervious cladding is laid loose, the joints abutting, the cladding being provided with welding edges along both sides, which may be water repellent. Thereupon mechanical anchorage is effected over the cladding material joints. This mechanical anchorage is preferably effected by means of specially designed hardware which is screwed to the roof structure. The hardware is so designed that it holds the cladding webs in place at all times so that they lie more or less abutting. Strips are now welded over the hardware, for example strips of conventional welding felt, so that the hardware and adjacent edges of the impervious cladding are covered by the strips, whereby complete sealing of the roof is achieved. This procedure achieves simultaneous anchorage of the vapour barrier, if employed, insulation material and impervious cladding in one operation, and this operation can be effected more or less independently of existing weather conditions.

The welding strip will also completely cover the fastening hardware and completely assure properly sealed joints and fastenings.

During the laying of the welding strip the welding apparatus will blow away any water from the welding edges of the cladding webs, simultaneously with the welding of the strip, so that also this operation can be carried out during rain.

By the aforedescribed procedures it is possible to lay and achieve a waterproof roof, more or less independently of weather and wind, which means that such part of the progress of the building as is dependent upon an impervious roof can be commenced immediately, while any final roof finish, which is not essential to the watertightness of the roof but only to its durability and esthetic appearance, can be carried out at any later time. The procedure will therefore facilitate better utilization of the working capacity of the roofing personnel, because they are not dependent upon existing weather conditions, and thus possible waiting time can be considerably reduced.

For hard weather areas, exposed places and other places, a special hardware device has been developed which comprises an approximately rectangular stiff plate which at each end is provided with gripping claws which are preferably produced by stamping the plate by means of suitable die stamping equipment. The plate is provided with at least one centrally located through-running hole, so that the plate can be fixed to the underlay by means of a screw or the like.

When the fixing device is to be installed it is placed in such a manner that the gripping claws are located in the webs of adjacent cladding material and so that the central hole, through which the screw is inserted, lies over the joint between adjacent material webs, whereupon the screw is inserted and screwed in so that the claws pass through the respective webs and hold these together. The number of fixing devices employed per unit length will depend upon the local wind conditions during the roof cladding operation.

In cases where it is not desirable to lay a separate insulation layer the impervious cladding can be anchored to the underlay at its welding edges before the said strips are welded in place, by means of known devices as roofing felt nails, staples or the like.

In cases where the roof is to be loaded, for example with gravel, mechanical anchorage may be omitted, but the procedure is otherwise as described above.

DETAILED DESCRIPTION OF THE INVENTION

Figure 1:
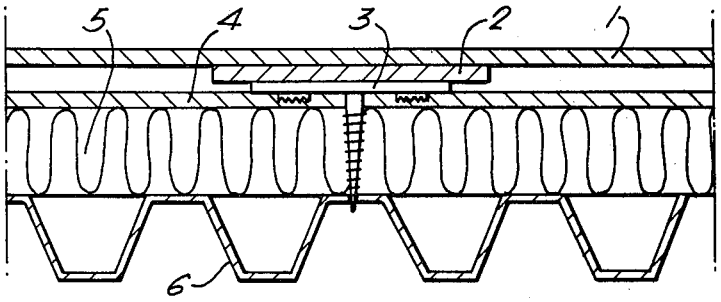
In FIG. 1 is shown a section of a roof cladded according to the invention.
Figure 2:
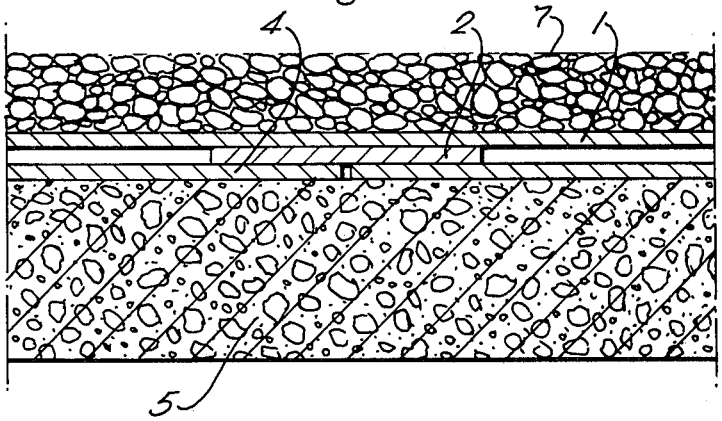
In FIG. 2 is shown a cladded roof, provided with a loading layer of for instance gravel, and in FIG. 3 is shown the fastening device used for mechanical anchorage of the impervious cladding.

In FIG. 1, (1) designates the over layer or top layer. (2) designates the welding strip which completely covers the fastening device 3. (4) designates the impervious cladding. (5) designates the insulation layer and (6) the supporting structure in the form of corrugated plates. In FIG. 2, (7) represents a loading layer of gravel supported on top layer 1, (2) the welding strip, (4) the impervious cladding and (5) the supporting structure in the form of for instance concrete or expanded concrete. Mechanical anchorage, such as fastening device 3, is omitted from this cladded roof embodiment.

Figure 3:
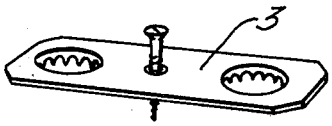

FIG. 3 shows in greater detail the fastening device comprising a rectangular stiff plate which at each end is provided with gripping claws which are preferably produced by stamping the plate by means of a suitable die stamping equipment. The plate is provided with at least one centrally located through running hole, so that the plate can be fixed to the under lay by means of a screw or the like.

I claim:

1. A process for the cladding of a roof on to a support structure, comprising the steps of applying, without securing, a layer of insulation over said structure, applying, without securing, webs of impervious cladding material over said layer of insulation, said webs being applied with adjacent edges thereof in abutting relationship, simultaneously anchoring said insulation layer and said cladding mechanically to said structure, said anchoring step including the application of fastening devices which span said edges of said webs for simultaneously holding them in place, and sealing over said edges of said webs as well as over said fastening devices by welding on welding strips for covering said edges and said devices.

* * * * *